US006957861B1

(12) United States Patent
Chou et al.

(10) Patent No.: US 6,957,861 B1
(45) Date of Patent: Oct. 25, 2005

(54) STRUCTURE OF A MESH BACK OF A CHAIR

(75) Inventors: Ting-Kuo Chou, Tainan (TW); Kuo-Ching Chou, Tainan (TW)

(73) Assignee: Comfordy Co., Ltd., Tainan Hsien (TW)

( * ) Notice: Subject to any disclaimer, the term of this patent is extended or adjusted under 35 U.S.C. 154(b) by 0 days.

(21) Appl. No.: 11/046,812

(22) Filed: Feb. 1, 2005

(51) Int. Cl.[7] ..... A47C 3/025
(52) U.S. Cl. ..... 297/284.7; 297/452.64
(58) Field of Search ..... 297/284.4, 284.7, 297/284.5, 284.1, 452.64, 452.13

(56) References Cited

U.S. PATENT DOCUMENTS 6,354,662 B1 * 3/2002 Su ..... 297/284.7
6,575,530 B1 * 6/2003 Fischer et al. ..... 297/284.4
6,588,842 B2 * 7/2003 Stumpf et al. ..... 297/284.4
6,695,403 B1 * 2/2004 Su ..... 297/284.7
6,811,215 B2 * 11/2004 Horiki et al. ..... 297/228.1
6,843,530 B1 * 1/2005 Wu ..... 297/284.4
2003/0137172 A1 * 7/2003 Chu ..... 297/284.5

* cited by examiner

*Primary Examiner*—Milton Nelson, Jr.
(74) *Attorney, Agent, or Firm*—Rosenberg, Klein & Lee

(57) ABSTRACT

A mesh chair back includes a loop-shaped frame, an elastic mesh part, a waist support unit, and a smooth separating plate; the loop-shaped frame has left and right upright portions; the elastic mesh part is positioned over and secured on the loop-shaped frame; the waist support unit is arranged behind the elastic mesh part, and connected to the left and the right upright portions of the loop-shaped frame at two ends in an up and down displaceable manner; the smooth separating plate is positioned between the mesh part and the waist support unit for preventing the waist support unit from rubbing and causing wear to the mesh part while the waist support unit is being adjusted in height; the waist support unit props the separating plate and the mesh part forwards such that the separating plate and the mesh part each has a forwards protruding portion.

7 Claims, 8 Drawing Sheets

STRUCTURE OF A MESH BACK OF A CHAIR

BACKGROUND OF THE INVENTION

1. Field of the Invention

The present invention relates to a mesh back of a chair, more particularly one, which has a smooth separating plate positioned between an elastic mesh part and an adjustable waist support unit thereof for preventing the waist support unit from rubbing and causing wear to the mesh part while the waist support unit is being adjusted in height.

2. Brief Description of the Prior Art

Chair backs are usually made by means of wrapping leather or cloth around wooden or plastic main bodies thereof. Such chair backs are likely to make the sitters feel hot and uncomfortable at their backs, especially in summer, because air cannot travel through them. Another chair back is provided, which is comprised of a loop-shaped frame, and a mesh, which has large elasticity, and which is positioned over and secured to the frame. Such mesh back of a chair allows air to travel through it therefore sitters won't feel uncomfortably hot at their backs even if they have been sitting on the chair for a long time in summer. However, one is prone to have sore waist and painful back after having been seated in the chair for a long period of time because the mesh of such chair back can't support their backs in a proper position effectively.

To overcome the above disadvantages, referring to FIGS. 1 and 2, an improvement 10 on a chair is provided, of which the back includes a mesh 1, a loop-shaped frame 11, and a waist support 2 connected to the frame 11. The mesh 1 is positioned over and securely connected to the frame 11. The loop-shaped frame 11 has two vertical slots 111 at left ad right upright portions thereof, and two stick-shaped portions 112 next to the slots 111. The waist support 2 has two fitting hooks 21 at two ends thereof. The waist support 2 is connected to the frame 11 with the fitting hooks 21 being passed through respective ones of the vertical slots 111, and tightly gripping respective ones of the stick-shaped portions 112 of the frame 11; normally, the waist support 2 is steady on the frame 11, and it can be relocated to a different height to suit the sitter. Therefore, one can't have a painful back or sore waist after having been seated on the chair for a long time.

However, because the mesh 1 is rough, and the waist support 2 touches the mesh 1, the waist support 2 will rub the mesh 1 when it is up and down displaced for adjustment of the height. Consequently, the waist support 2 can't move smoothly, and it will cause wear and breakage of the mesh 1.

SUMMARY OF THE INVENTION

It is a main object of the invention to provide an improvement on a mesh back of a chair to overcome the above disadvantages.

The mesh chair back of the invention includes a loop-shaped frame, an elastic mesh part, a waist support unit, and a smooth separating plate. The frame has left and right upright portions while the elastic mesh part is positioned over and secured on the frame. The waist support unit is arranged behind the elastic mesh part, and connected to the left and the right upright portions of the frame at two ends thereof in an up and down displaceable manner. The separating plate is positioned between the mesh part and the waist support unit for preventing the waist support unit from rubbing and causing wear to the mesh part while the waist support unit is being adjusted in height; thus, the waist support unit can move smoothly when being adjusted. The waist support unit props both the separating plate and the mesh part forwards, and in turn the separating plate curves in such a way that the sitter's waist is more comfortable.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
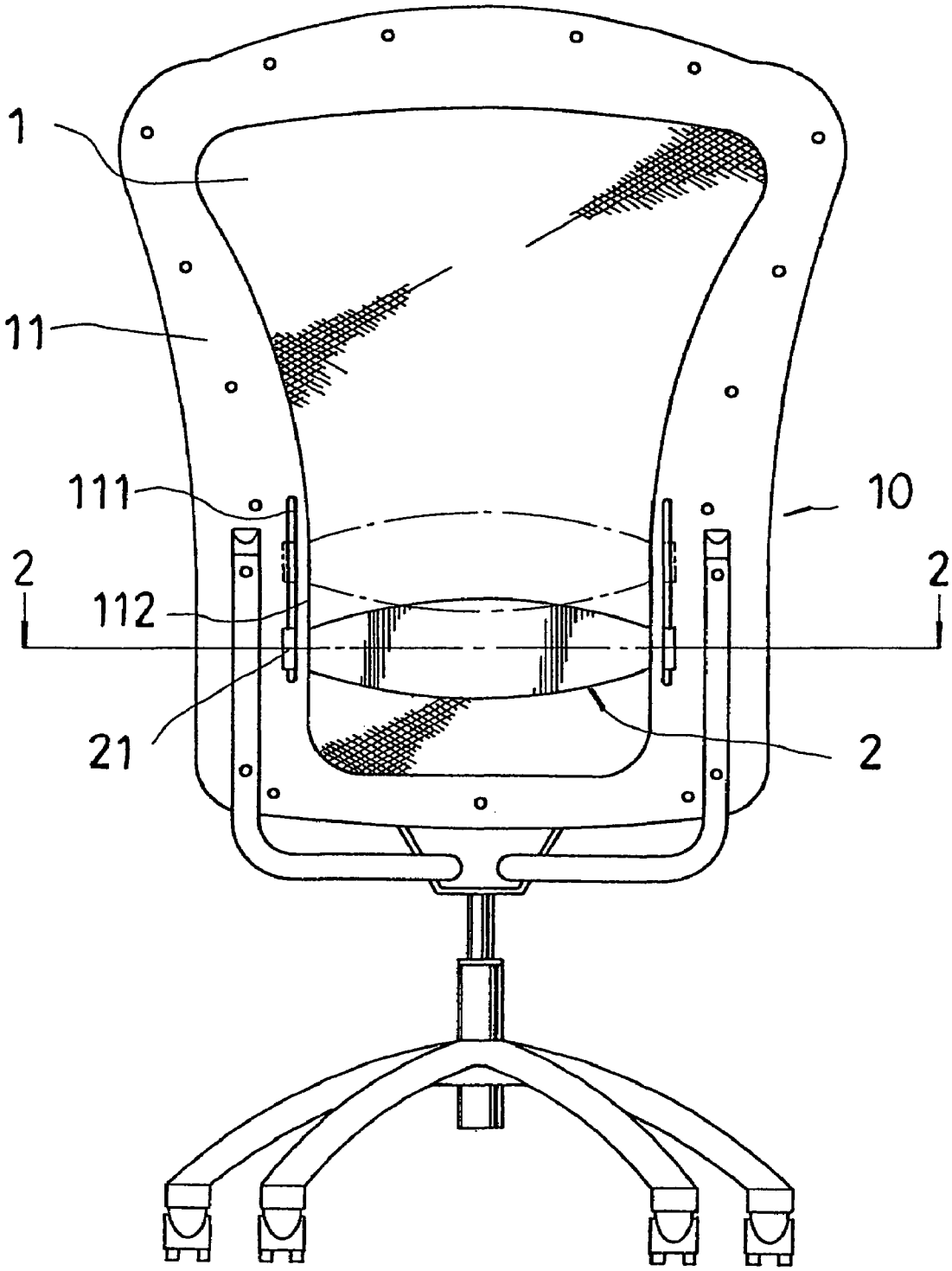
FIG. 1 (PRIOR ART)
FIG. 1 is a rear view of the conventional chair.
Figure 2:
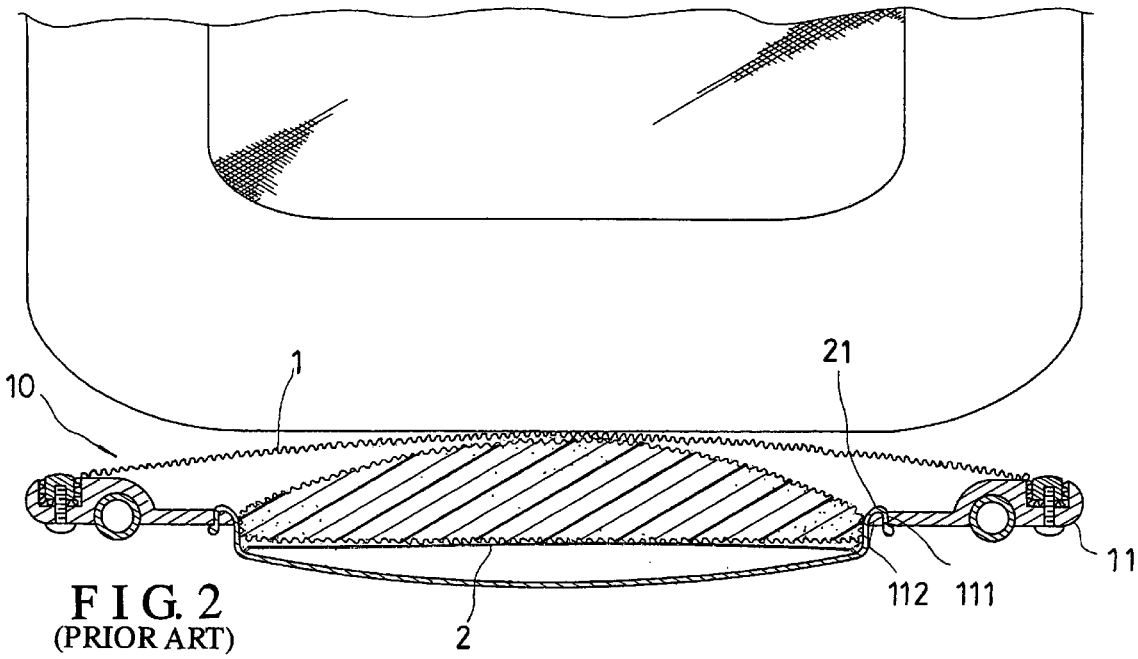
FIG. 2 (PRIOR ART)
FIG. 2 is a horizontal section of the conventional back of a chair.
Figure 3:
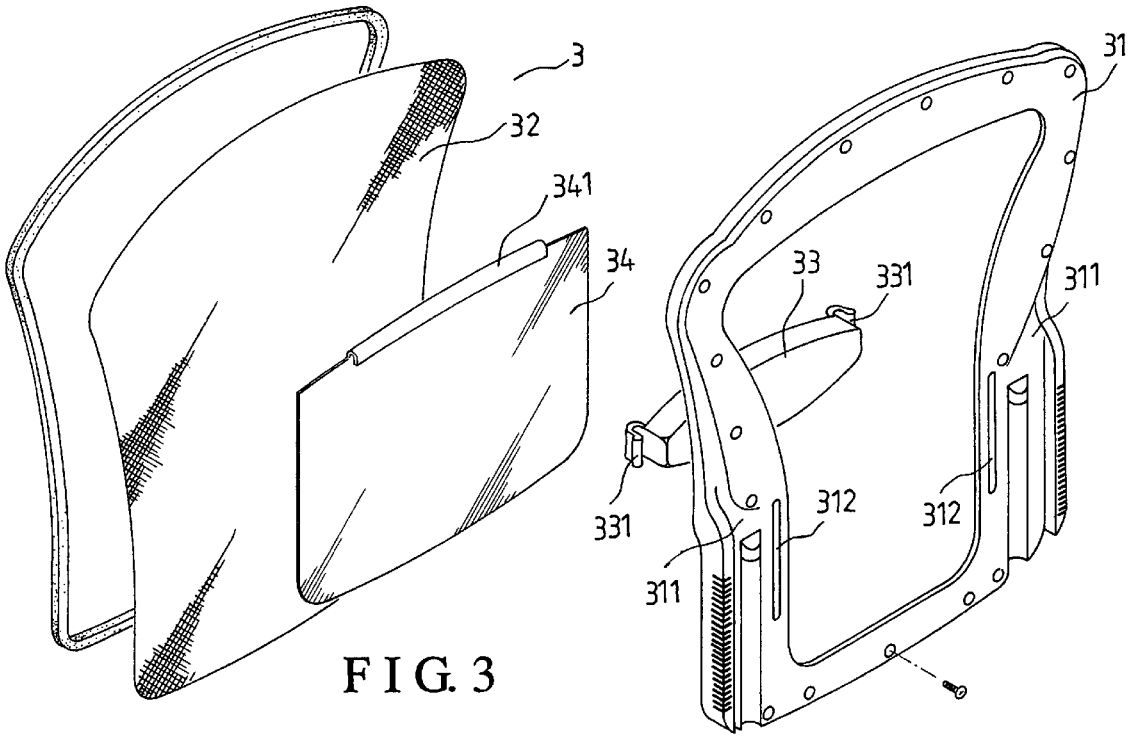
FIG. 3 is an exploded perspective view of the first embodiment of a mesh back of a chair according to the invention.

Referring to FIGS. 1 and 2, a preferred embodiment 3 of a mesh back of a chair includes a frame 31, a mesh part 32, a waist support unit 33, and a separating plate 34.

The frame 31 is loop-shaped, and has left and right upright portions 311, and vertical slots 312 on the left and the right upright portions 311.

The mesh part 32 is elastic, and it is positioned over and secured on the frame 31.

The waist support unit 33 has connecting hooks 331 at two ends, and it is positioned behind the mesh part 32, and connected to the frame 31 with the connecting hooks 331 being passed through respective ones of the vertical slots 312 and hooked over the upright portions 311 of the frame 31; thus, the waist support 33 will normally be held steady on the frame 31, and people can displace the waist support unit 33 to other positions by means of exerting force. Therefore, the waist support unit 33 can be relocated to a different height according to the sitter's need.

The separating plate 34 has a smooth surface, and has a larger width than the waist support unit 33. The separating plate 34 is positioned between the mesh part 32 and the waist support unit 33 such that the mesh part 32 and the waist support unit 33 are separated. And, the waist support unit 33 props the separating plate 34 as well as the mesh part 32 slightly forwards, and in turn the separating plate 34 and the mesh part 32 each has a portion protruding forwards. Because the waist support unit 33 touches the smooth separating plate 34 instead of the mesh part 32, the waist support unit 33 will move smoothly when one person adjusts the height of the waist support unit 33. And, the separating plate 34 has such a height as to cover the range of up and down adjustment movement of the waist support unit 33. In the present embodiment, the separating plate 34 is movable, instead of being secured to the frame 31, and left and right ends of the separating plate 34 are between the mesh part 32 and the upright portions 311 of the frame 31. And, the separating plate 34 has an extension portion 341 at an upper end thereof, which curves downwards, and has a convex side facing upwards; thus, one person is allowed to hold the separating plate 34 by the extension portion 341 in removing the separating plate 34 from the frame 31, and in fitting the separating plate 34 in position. The separating plate 34 can be transparent or opaque, and it can be colored.

Because the waist support unit 33 doesn't touch the mesh part 32, it won't rub the mesh part 32 when it is adjusted in the height. Consequently, when the waist support unit 33 is adjusted in the height, it can move smoothly. And, the waist support unit 33 won't cause wear of the mesh part 32 in adjustment movement.

Furthermore, because the waist support unit 33 props the separating plate 34 slightly forwards, the separating plate 34 will slightly curve at those portions thereof that are near to the edges of the waist support unit 33. Therefore, when one person is seated on the chair, there will be a larger area provided on the chair back for the sitter's waist to closely touch, and in turn the edges of the waist support unit 33 won't make the sitter feel uncomfortable.

Figure 4:
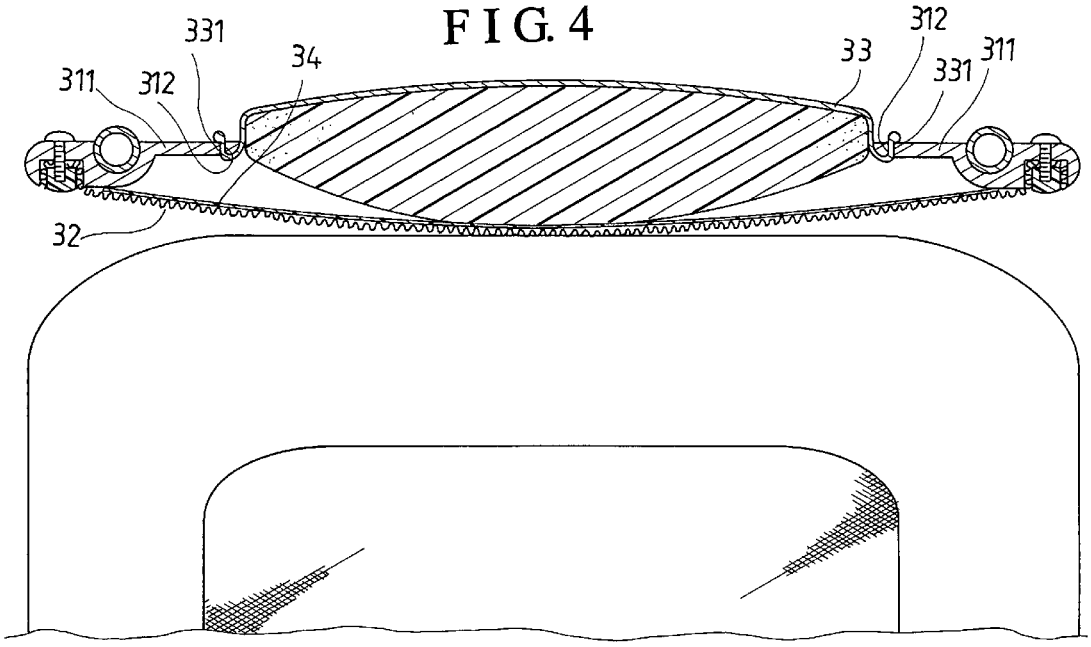
FIG. 4 is a horizontal sectional view of the first embodiment.
Figure 5:
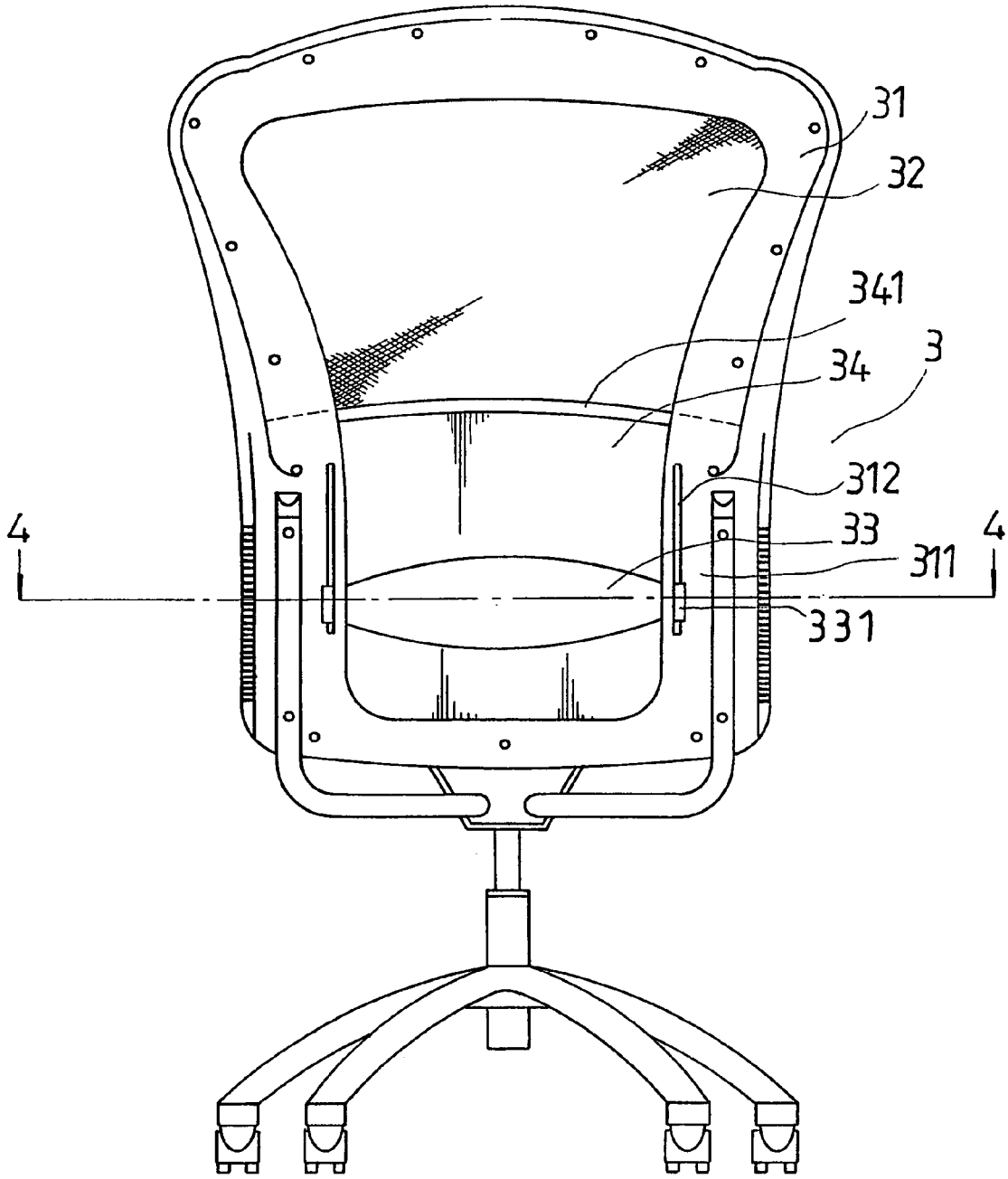
FIG. 5 is a rear view of the first embodiment.
Figure 6:
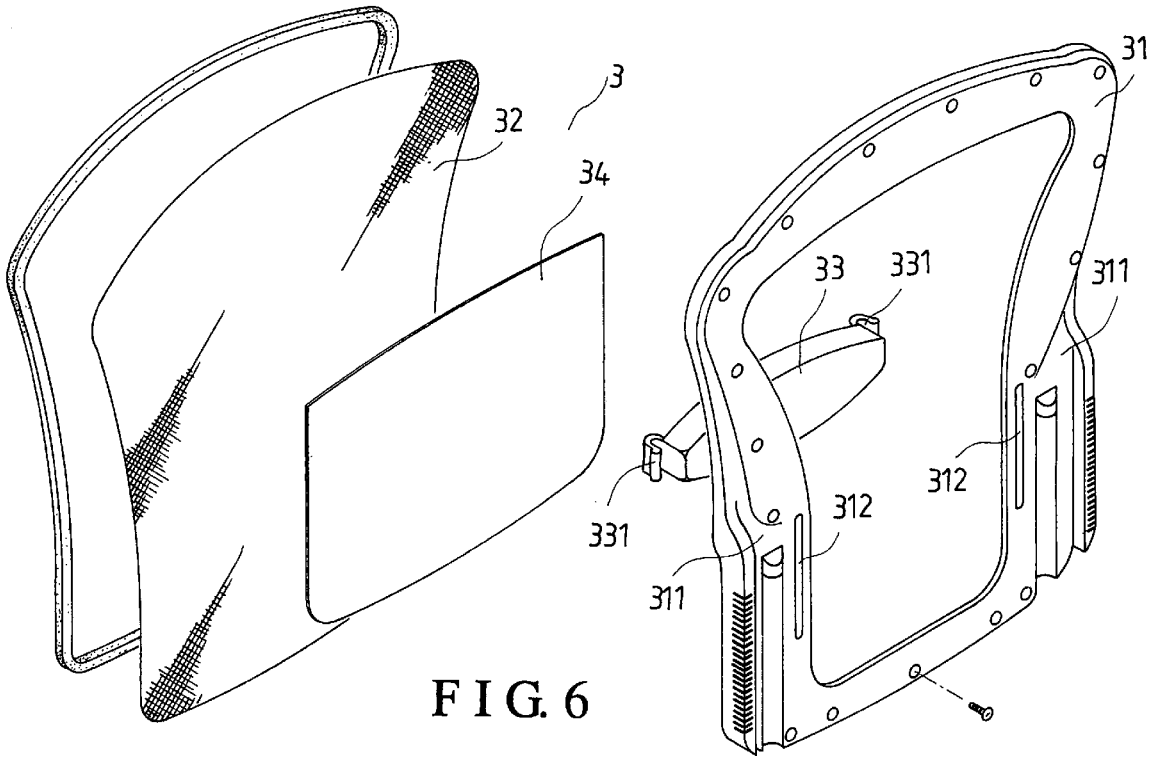
FIG. 6 is an exploded perspective view of the second embodiment of a mesh back of a chair according to the invention.
Figure 7:
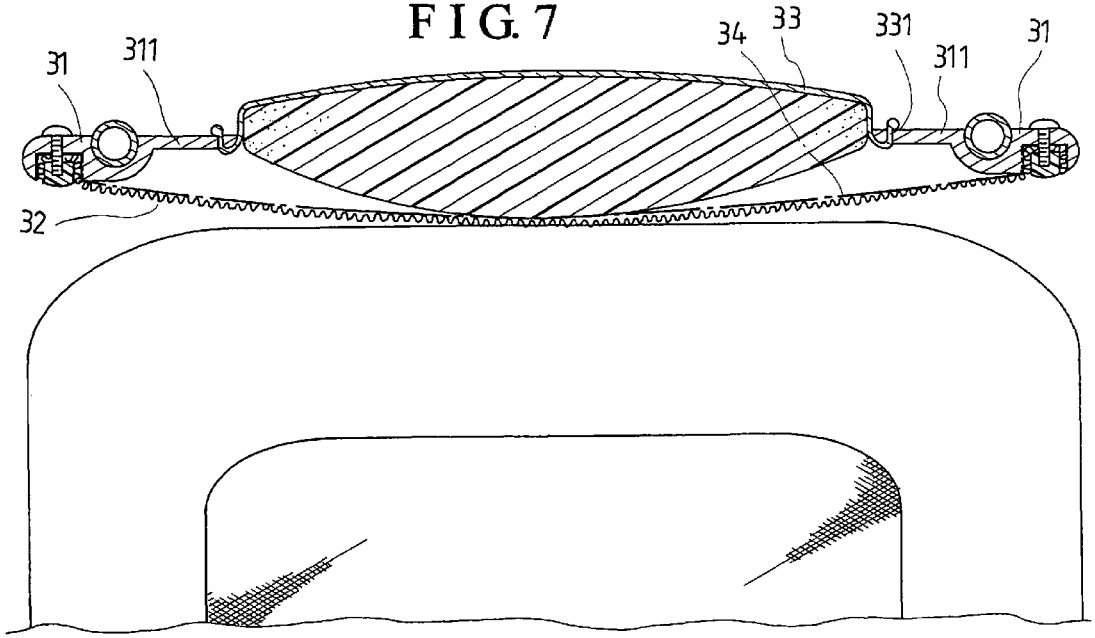
FIG. 7 is a horizontal sectional view of the second embodiment.
Figure 8:
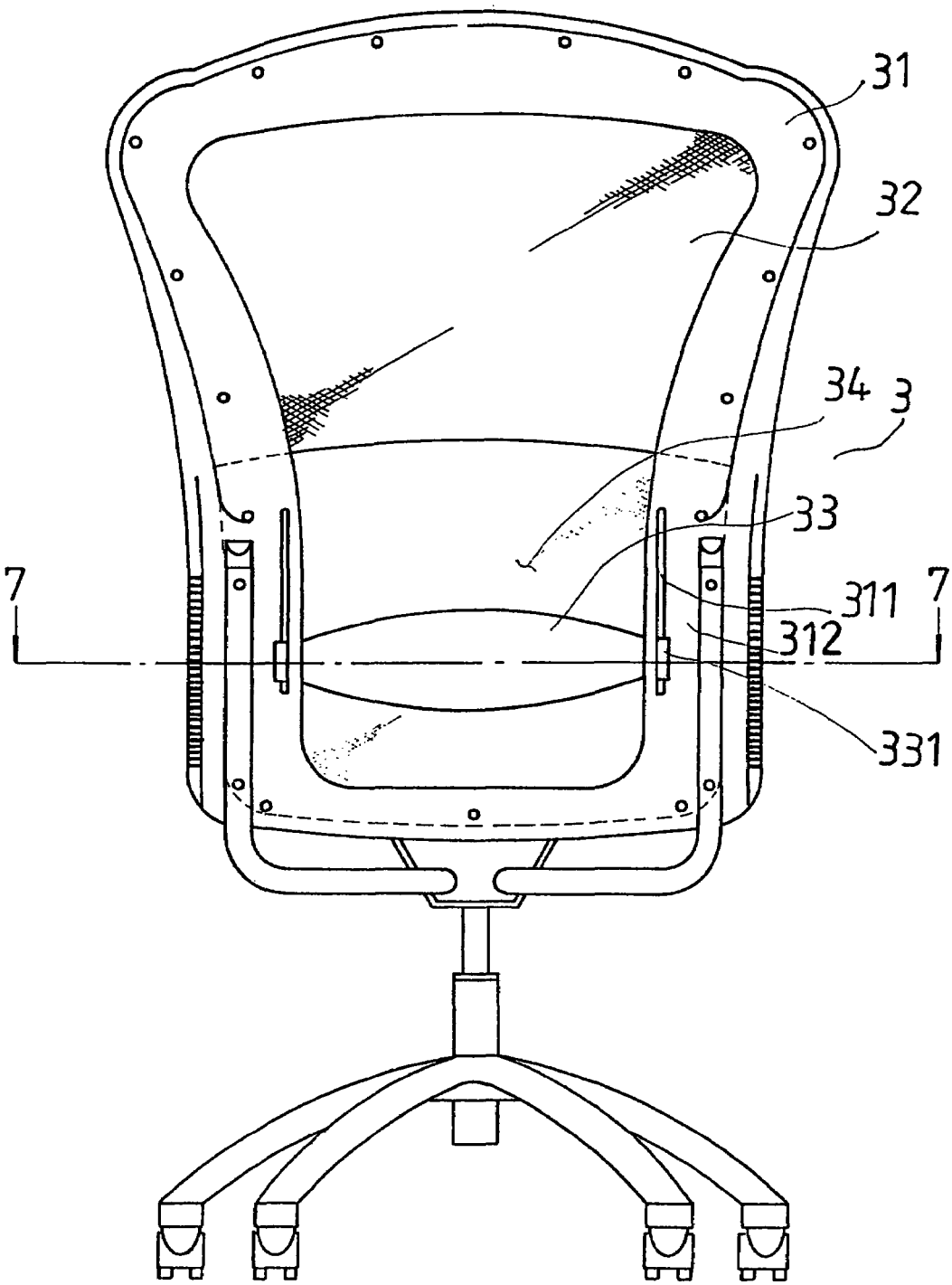
FIG. 8 is a rear view of the second embodiment.

Referring to FIGS. 4 to 6, in another embodiment of the invention, the separating plate 34 is adhered to the rear side of the mesh part 32, and secured on the frame 31 together with the mesh part 32 instead of being movable relative to the frame 31 and the mesh part 32.

From the above description, it can be easily understood that the mesh chair back of the present invention has advantages as followings:

1. Because the waist support unit and the mesh part are separated by means of the separating plate, the waist support unit won't rub the mesh part to cause wear of the mesh part while it is being moved for adjustment of height.

2. The waist support unit can be smoothly moved relative to the frame virtually without frictional resistance because the waist support unit touches the separating plate instead of the mesh part.

3. Because the separating plate touches the waist support unit, and slightly curves at those portions thereof that are near to the edges of the waist support unit, there will be a larger area provided on the chair back for the sitter's waist to closely touch. Consequently, the sitter's waist will be more comfortable.

4. The separating plate of the first embodiment, which is movable relative to the frame, has the extension portion at the upper end. Therefore, one is allowed to hold the separating plate by the extension portion, and in turn he/she will be able to remove the separating plate with ease, and to fit the separating plate in position with ease.

5. To offer the consumers an additional choice, the separating plate of the second embodiment is adhered to the rear side of the mesh part, and secured on the frame instead.

What is claimed is:

1. A mesh back of a chair, comprising a loop-shaped frame; the loop-shaped frame having left and right upright portions;

an elastic mesh part positioned over and secured on the loop-shaped frame;

a waist support unit behind the elastic mesh part; the waist support unit being connected to the left and the right upright portions of the loop-shaped frame at two ends thereof in an up and down displaceable manner; and a separating plate having a smooth surface; the separating plate being positioned between the mesh part and the waist support unit; the waist support unit propping the separating plate as well as the mesh part forwards such that the separating plate and the mesh part each has a portion protruding forwards.

2. The mesh back of a chair as claimed in claim 1, wherein the separating plate has an extension portion at an upper end thereof such that one person is allowed to hold the separating plate by the protrusion in removing the separating plate, and in fitting the separating plate in position.

3. The mesh back of a chair as claimed in claim 2, wherein the extension portion of the separating plate curves downwards, and has a convex side facing upwards.

4. The mesh back of a chair as claimed in claim 1, wherein the separating plate is adhered to a rear side of the mesh part, and secured on the frame together with the mesh part.

5. The mesh back of a chair as claimed in claim 1, wherein the separating plate is transparent.

6. The mesh back of a chair as claimed in claim 1, wherein the separating plate is opaque.

7. The mesh back of a chair as claimed in claim 1, wherein the separating plate is colored.

* * * * *